US005886717A

United States Patent [19]

Satake et al.

[11] Patent Number: 5,886,717

[45] Date of Patent: Mar. 23, 1999

[54] PRINTING HEAD FOR AN INK JET PRINTER WITH TITANIUM PLATE COMB

[75] Inventors: Kenichi Satake; Koichi Baba; Kikunosuke Tsuji; Takeshi Watanabe; Setsuo Hori, all of Osaka; Yoko Ohba, Yokohama, all of Japan

[73] Assignee: Mita Industrial Co., Ltd., Osaka-fu, Japan

[21] Appl. No.: 553,805

[22] Filed: Oct. 23, 1995

[30] Foreign Application Priority Data

Oct. 26, 1994 [JP] Japan ..... 6-262852

[51] Int. Cl.[6] ..... B41J 2/045

[52] U.S. Cl. ..... 347/70; 347/72

[58] Field of Search ..... 347/70, 71, 72, 347/68

[56] References Cited

U.S. PATENT DOCUMENTS

| | | | |
|---|---|---|---|
| 4,916,464 | 4/1990 | Ito et al. | 347/237 |
| 5,530,465 | 6/1996 | Hasegawa et al. | 347/70 |
| 5,592,206 | 1/1997 | Watanabe et al. | 347/238 X |

FOREIGN PATENT DOCUMENTS

| | | | |
|---|---|---|---|
| 4-371845 | 12/1992 | Japan | 347/70 |

OTHER PUBLICATIONS

Patent Abstracts of Japan vol. 007 No. 230 (M–249), 12 Oct. 1983 & JP–A–58 122878 (RICOH KK) 21 Jul. 1983—abstract.

Patent Abstracts of Japan vol. 7 No. 81 (M–205) [1226], 5 Apr. 1983 & JP–A–58 007364 (Epuson K.K.)—abstract.

Patent Abstracts of Japan vol. 009 No. 209 (M–407), 27 Aug. 1985 & JP–A–60 068963 (Konishiroku Shashin Kogyo KK) 19 Apr. 1985—abstract.

Patent Abstracts of Japan vol. 6 No. 101 (M–135) [979], 10 Jun. 1982 & JP–A–57 034973 (Nippon Denki K.K.)—abstract.

Patent Abstracts of Japan vol. 018 No. 388 (E–1581), 20 Jul. 1994 & JP–A–06 112543 (Seiko Epson Corp) 22 Apr. 1994—abstract.

Patent Abstracts of Japan vol. 017 No. 537 (M–1487), 28 Sep. 1993 & JP–A–05 147215 (Tokyo Electric Co Ltd; Others: 01) 15 Jun. 1993—abstract.

Patent Abstracts of Japan vol. 016 No. 094 (M–1219), 9 Mar. 1992 & JP–A–03 274159 (Brother Ind LTD) 5 Dec. 1991—abstract.

Patent Abstracts of Japan vol. 940 No. 010 & JP–A–06 283706 (ROHM Co LTD 7 Oct. 1994)—abstract.

*Primary Examiner*—David F. Yockey
*Attorney, Agent, or Firm*—Jordan and Hamburg

[57] ABSTRACT

A printing head for an ink jet printer is provided with a plurality of ink jet sets. Each of the ink jets. Each of the ink jets includes an ink nozzle through which ink is ejected; a pressure chamber communicated with the ink nozzle and having a diaphragm made of a flexible plate; and a piezoelectric member bonded on an outside of the diaphragm for deforming the diaphragm to eject ink through the ink nozzle from the pressure chamber. The piezoelectric member includes a layer, having titanium an upper PZT layer chemically bonded on an upper surface of the titanium layer and polarized in a first direction; and a lower PZT layer chemically bonded on a lower surface of the titanium layer and polarized in a second direction opposite to the first direction. The titanium layer includes an interconnecting member and titanium members interconnected to each other by the interconnecting member forming a single titanium plate comb having teeth corresponding to the titanium members extending from two sides of the interconnecting member.

2 Claims, 13 Drawing Sheets

PRINTING HEAD FOR AN INK JET PRINTER WITH TITANIUM PLATE COMB

BACKGROUND OF THE INVENTION

This invention relates to a printing head for use in an ink jet printer and a method for producing a printing head.

In conventionally known arrangements, a printing head for an ink jet printer employs piezoelectric elements as actuators. FIG. 14 is a fragmentary sectional view showing a construction of a conventional Kyser type printing head. A printing head 300 has on its surface a plurality of dot printing sections 305 arranged in an array extending at right angles to the section of FIG. 14, each dot printing section 305 comprising a front ink passage 301*a*, a pressure chamber 301*b*, a rear ink passage 301*c*, an ink nozzle 303*a*, an ink jet outlet 303*b* and a piezoelectric element 304.

The front ink passages 301*a*, pressure chambers 301*b* and rear ink passages 301*c* of the individual dot printing sections 305 are constructed by forming a specific pattern of recesses on a surface of a substrate 301 which is made of Photosensitive glass and then bonding a diaphragm 302 to the surface of the substrate 301 with an adhesive. Each piezoelectric element 304 serves as a pressure source for the front ink passage 301*a*. It is produced by forming electrodes 304*a* and 304*b* on opposite surfaces of a piezoelectric member 304*c* made of lead zirconate-titanate (hereinafter referred to as "PZT"), for instance. The individual piezoelectric elements 304 are bonded to the diaphragm 302 with an adhesive just at the positions of the pressure chambers 301*b*.

The ink nozzles 303*a* and ink jet outlets 303*b* of the individual dot printing sections 305 are made by bonding a nozzle plate 303, in which a pattern of the ink nozzles 303*a* and ink jet outlets 303*b* is preformed, to an end of the substrate 301, to which the diaphragm 302 is already attached, by use of an ultraviolet-curing adhesive.

The diaphragm 302 forms flexible walls of the pressure chambers 301*b* as well as walls of the front ink passages 301*a* and rear ink passages 301*c*.

The printing head 300 is produced in the following procedure. First, a surface of the substrate 301 made of photosensitive glass is subjected to a photolithographic process to form a recessed pattern of the front ink passages 301*a*, pressure chambers 301*b* and rear ink passages 301*c*. Then, the diaphragm 302 also made of photosensitive glass is bonded to the surface of the substrate 301 with the adhesive. The substrate 301 joined with the diaphragm 302 is hereinafter referred to as a "head assembly 306".

Next, a layer 307 of indium tin oxide (hereinafter referred to as "ITO") is formed as a common electrode on an outside surface of the diaphragm 302 of the head assembly 306. The piezoelectric elements 304 readily produced as discrete components are bonded to the diaphragm 302 just at the locations of the pressure chambers 301*b* with an epoxy adhesive. Then, the nozzle plate 303 having a water repellent finish on its ink streaming surfaces is bonded to the front end of the head assembly 306 with the aforementioned ultraviolet-curing adhesive to complete the printing head 300.

To produce elongate printing heads for constructing a line head suitable for standard A4-size paper, for instance, there should typically be 5100 dot printing sections available. For this, it is essential to develop a technique to arrange a large number of dot printing sections on a line head structure at high density and high accuracy. In particular, individual piezoelectric members which will serve as pressure sources must be small-sized and yet provide great electrostriction. Furthermore, they must be attached in exact locations of individual pressure chambers.

The above-mentioned conventional printing head 300 is produced by individually bonding the piezoelectric elements 304 prepared as discrete components to the diaphragm 302 at the locations of the pressure chambers 301*b* with the epoxy adhesive. This producing method is complicated and it is difficult to align the individual piezoelectric elements 304 with high positioning accuracy.

Although bimorph cells are known to provide higher electrostriction, it is difficult to use them as piezoelectric members in producing a line head of conventional type as a small-sized structure is essential.

SUMMARY OF THE INVENTION

It is an object of the present invention to provide a printing head for an ink jet printer and a method for producing a printing head which have overcome the problems residing in the prior art.

It is another object of the present invention to provide a printing head for an ink jet printer which can assure stable ink jet performance.

It is another object of the present invention to provide a method for producing a printing head which makes it possible to achieve high density and high accuracy attachment of bimorph-cell-type piezoelectric members.

The present invention is directed to a printing head for an ink jet printer comprising an ink jet set of: an ink nozzle through which ink is ejected; a pressure chamber communicated with the ink nozzle and having a diaphragm made of a flexible plate; and a piezoelectric member bonded on an outside of the diaphragm for deforming the diaphragm to eject ink through the ink nozzle from the pressure chamber, the piezoelectric member including: a layer having titanium; an upper PZT layer chemically bonded on an upper surface of the titanium layer and polarized in a first direction; and a lower PZT layer chemically bonded on a lower surface of the titanium layer and polarized in a second direction opposite to the first direction.

In this construction, the piezoelectric member can produce uniform and strong pressurizing force, and variations in pressurizing force are reduced.

The upper and lower PZT layers may be formed by depositing crystals of PZT on the upper and lower surfaces of the titanium layer in hydrothermal synthesis. This makes it possible to easily produce small-sized piezoelectric member which exhibit uniform and increased electrostriction.

It may be appreciated to provide a plurality of ink jet sets. The respective titanium layers of the plurality of piezoelectric members may be integrally connected with one another. Also, the respective titanium layers may be defined by a single titanium plate in the form of a comb having teeth, and the teeth of the single titanium plate correspond to the titanium layers respectively. The single titanium plate may be in the form of a comb having teeth arranged in a line at a predetermined interval. Further, the single titanium plate may be in the form of a comb having: a connecting strip portion; a first group of teeth extending from one side of the connecting strip portion, the first group of teeth being arranged at a predetermined interval in a lengthwise direction of the connecting strip portion; a second group of teeth extending from the other side of the connecting strip portion, the second group of teeth being arranged at a predetermined interval in the lengthwise direction of the connecting strip portion, the second group of teeth being shifted from the first group of teeth at a predetermined distance.

In these varied constructions, a plurality of bimorphcell-type piezoelectric member linked together by the single titanium plate can be simultaneously attached on pressure chambers. This facilitates high density and high accuracy assembly of a printing head.

Also, the present invention is directed to a method for producing a printing head comprising the steps: depositing an upper PZT layer and a lower PZT layer on an upper surface and a lower surface of a titanium layer in opposite directions respectively in hydrothermal synthesis: forming driving electrodes on respective outside surfaces of the upper and lower PZT layers to produce a bimorph-cell-type piezoelectric member; and bonding the bimorph-cell-type piezoelectric member on a diaphragm attached on a substrate at a position corresponding to a pressure chamber formed in the substrate.

This method makes it easy to produce bimorph-cell-type piezoelectric members having uniform quality, and further to align individual piezoelectric members in exact attachment positions so that a large number of piezoelectric members can be simultaneously attached to diaphragms with ease and high accuracy.

These and other objects, features and advantages of the invention will become more apparent upon a reading of the following detailed description of the preferred embodiments with reference to the appended drawings.

DETAILED DESCRIPTION OF THE INVENTION

Figure 1:
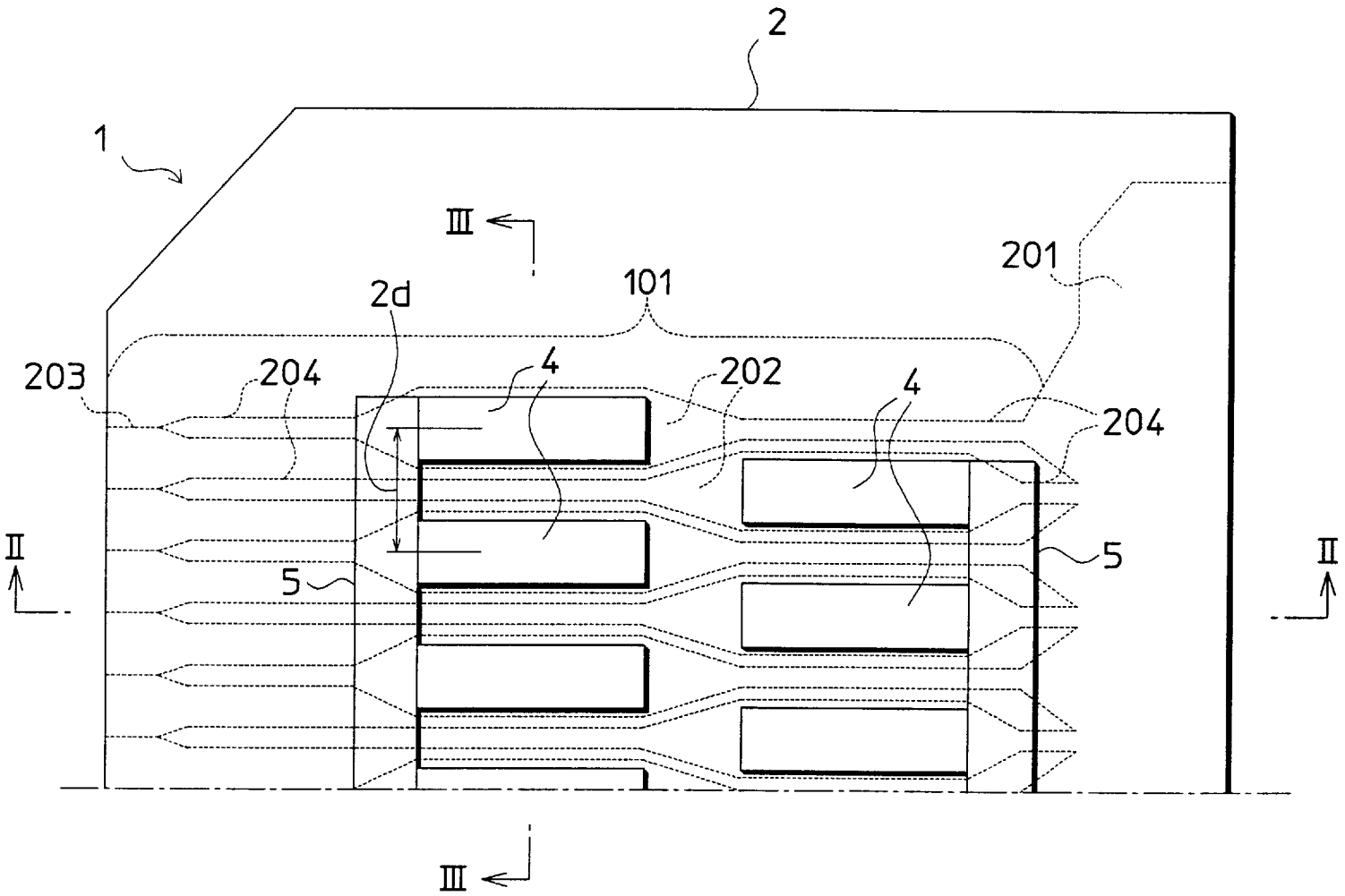
FIG. 1 is a fragmentary plan view showing a printing head for an ink jet printer as a first embodiment of the invention.
Figure 2:
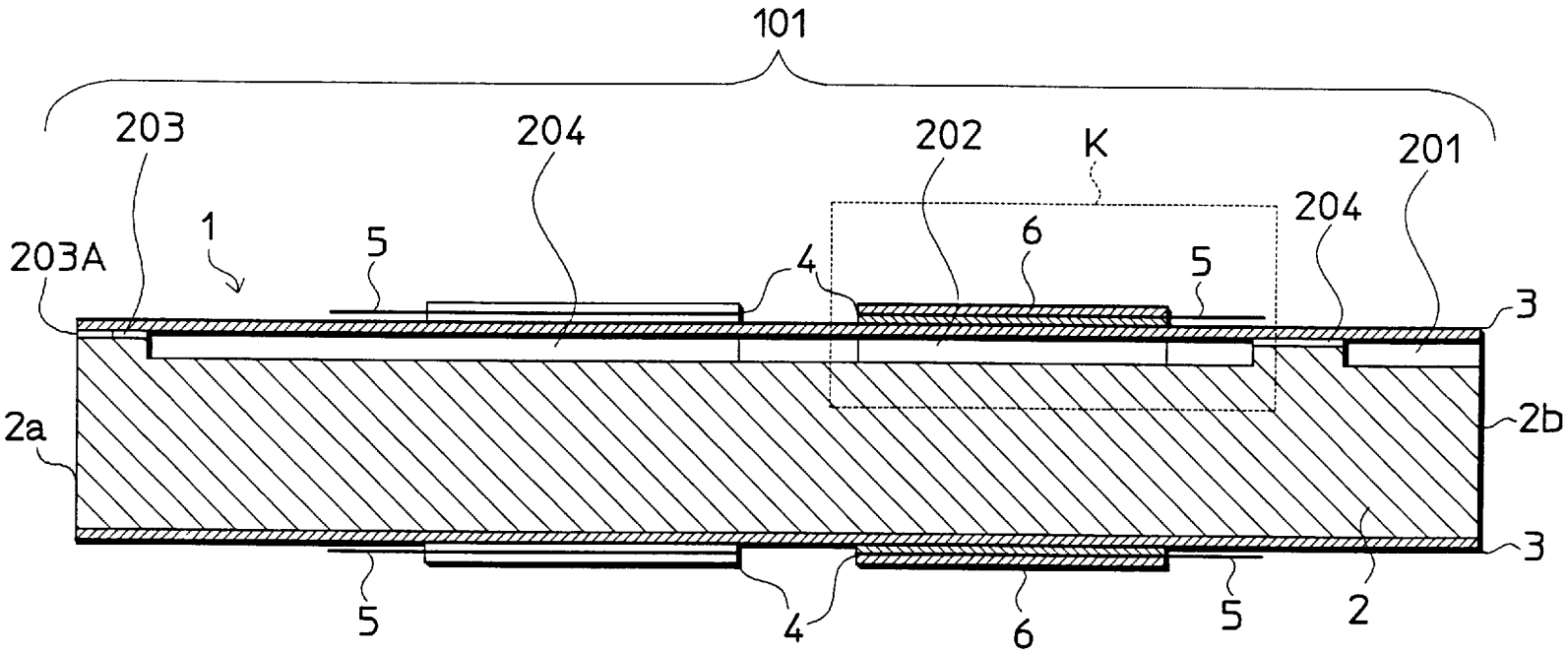
FIG. 2 is a sectional view taken along the line II—II of FIG. 1.
Figure 3:
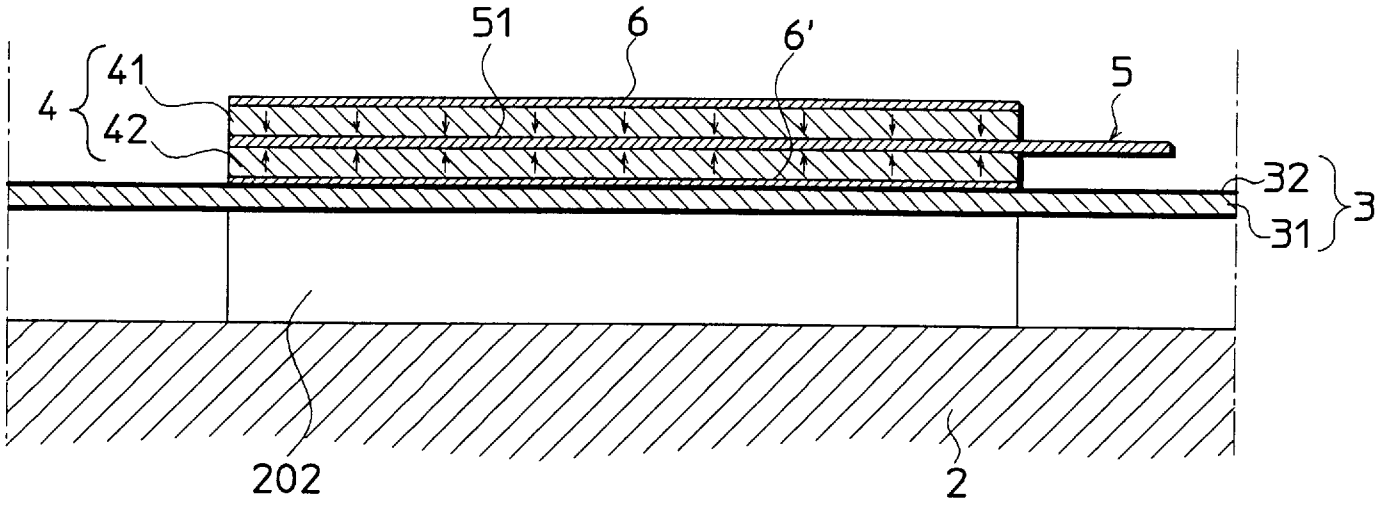
FIG. 3 is an enlarged sectional view of a pressurizing section K designated in FIG. 2.
Figure 4:
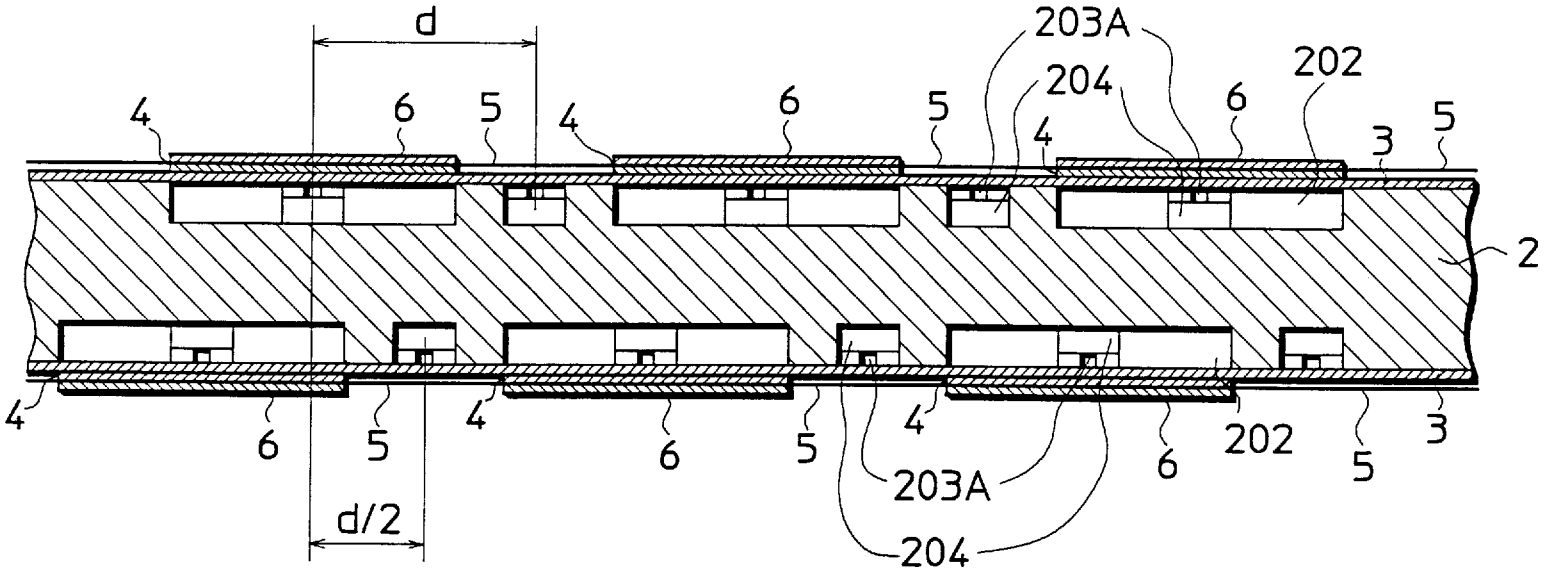
FIG. 4 is a fragmentary sectional view taken along the line IV—IV of FIG. 1.

FIG. 1 is a fragmentary plan view of a printing head for an ink jet printer according to a first embodiment of the invention; FIG. 2 is a sectional view taken along the line II—II of FIG. 1; FIG. 3 is an enlarged sectional view of a pressurizing section K designated in FIG. 2; and FIG. 4 is a fragmentary sectional view taken along the line IV—IV of FIG. 1.

Figure 10:
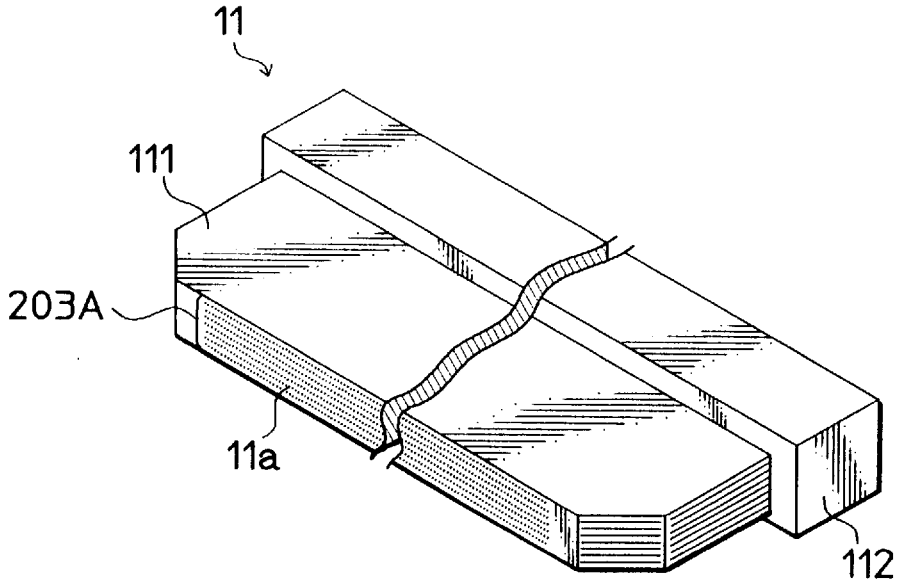
FIG. 10 is a perspective view of a line head.

A printing head 1 shown in FIGS. 1–4 is for constructing a line head 11 of FIG. 10 for printing on standard A4-size paper. In this embodiment, the line head 11 is formed by stacking ten printing heads 11 in layers. The Construction of the line head 11 will be described later in this specification.

Comprising a substrate 2 made of such insulating material as silicon or photosensitive glass, diaphragms 3 bonded to both sides of the substrate 2, each diaphragm 3 including an alkali-proof glass plate 31 of which whole outside surface is covered with a metallic layer 32 made of ITO (FIG. 3), for instance, and bimorph-cell-type piezoelectric elements 4 made of PZT, the printing head 1 has on its both sides 255 each dot printing sections 101.

The printing head 1 is shaped in a flat-plate form. Measuring the width of the printing head 1 in the direction of array of the dot printing sections 101 and the depth at right angles to the array, the printing head 1 is approximately 220 mm wide by 18 mm deep by 12 mm thick.

Each dot printing section 101 is configured with an ink reservoir 201, a pressure chamber 202, an ink nozzle 203, an ink jet outlet 203A and front and rear ink passages 204 which connect between the ink reservoir 201 and pressure chamber 202 and between the pressure chamber 202 and ink nozzle 203. The individual dot Printing sections 101 are made by first forming recessed portions which will serve as the ink reservoirs 201, pressure chambers 202, ink nozzles 203, ink jet outlets 203A and front and rear ink passages 204 on both the top and bottom sides of the substrate 2 and then bonding the diaphragms 3 to both sides with an adhesive. In this configuration, the diaphragms 3 form walls of the ink reservoirs 201, pressure chambers 202, ink nozzles 203, ink jet outlets 203A and front and rear ink passages 204.

As shown in FIG. 2, the ink reservoir 201, rear ink passage 204, pressure chamber 202, front ink passage 204 and ink nozzles 203 of each dot printing section 101 are arranged in a line in this order from the rear end (right side in FIG. 1) to the front end (left side in FIG. 1) of the substrate 2. Each ink jet outlet 203A having a rectangular shape for squirting a stream of ink droplets is provided on a foremost end face 2*a* of the substrate 2.

The individual dot printing sections 101 are arranged widthwise along the printing head 1 in such a manner that the ink jet outlets 203A align producing a dot pitch of about 0.85 mm. As shown in FIG. 4, the top and bottom arrays of the ink jet outlets 203A are separated by approximately 1 mm from each other, and the individual ink jet outlets 203A in the bottom array are offset by just a half-pitch length with respect to those in the top array.

The ink reservoir 201 from where ink is supplied is shared by all the dot printing sections 101 formed on each side of the printing head 1. The ink reservoir 201 has an opening on a rearmost end face 2*b* of the printing head 1. Ink is delivered through this opening via a piping from an ink source. The pressure chamber 202 of each dot printing section 101 is for pressurizing ink to produce ink droplets streaming from the relevant ink jet outlet 203A. Pressure is applied to the ink as the wall (i.e., the diaphragm 3) of the pressure chamber 202 is bent inward, causing a reduction in its internal volume, due to the inverse piezoelectric effect of the piezoelectric element 4. To arrange the ink jet outlets 203A at high density, the pressure chambers 202 of the successive dot printing sections 101 are alternately formed in positions mutually offset in their longitudinal direction as shown in FIG. 1.

The ink nozzle 203 of each dot printing section 101 regulates the size of individual ink droplets ejected from the ink jet outlet 203A. The pressure chamber 202, front and rear ink passages 204 and ink nozzle 203 individually have rectangular cross sections and the sectional area is decreased in a step-by-step manner between the pressure chamber 202 and ink jet outlet 203A. In this embodiment, sectional area Si of the pressure chamber 202, S2 of the ink passages 204 and S3 of the ink nozzle 203 are, for instance, S1=0.15 $mm^2$, S2=0.03 $mm^2$ and S3=0.0025 $mm^2$, respectively. As seen from FIG. 1, transitional portions between the pressure chamber 202 and front and rear ink passages 204 and between the front ink passage 204 and ink nozzle 203 are tapered to prevent sudden changes in the sectional area so that a smooth ink flow is obtained.

On each side of the substrate 2, there is formed a specified pattern of recesses having the shapes of the ink reservoir 201, pressure chambers 202, ink nozzles 203 and front and rear ink passages 204 of the individual dot printing sections 101 by use of photolithographic technique.

As previously mentioned, the diaphragms 3 are bonded to both the top and bottom sides of the substrate 2 to form walls of the ink reservoirs 201, pressure chambers 202 and so on of the individual dot printing sections 101. The metallic layer 32 made of ITO, for instance, formed on each diaphragm 3 serves as a common electrode for the individual piezoelectric elements 4.

Figure 6:
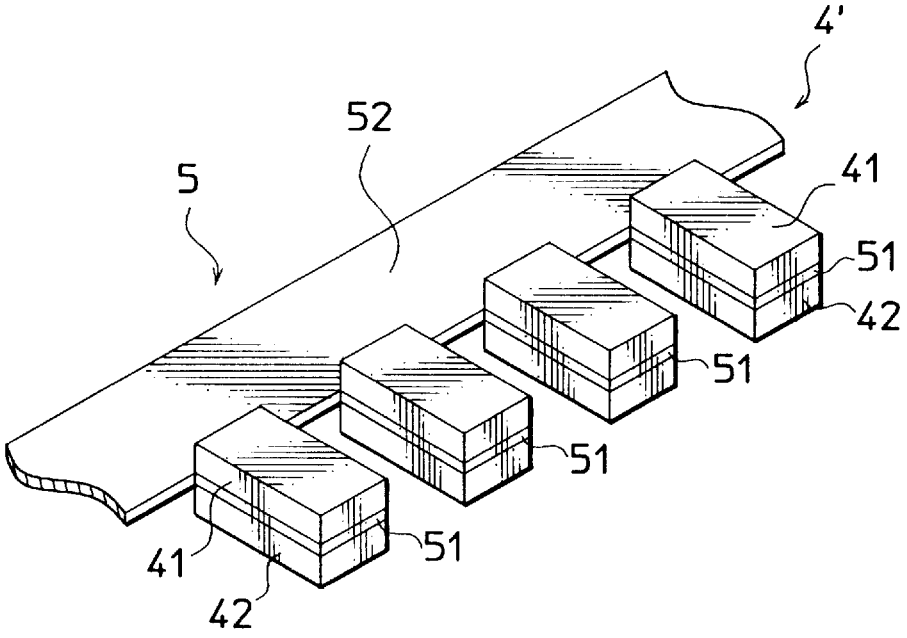
FIG. 6 is a perspective view showing how PZT layers are produced on crystallizing teeth of the electrode member.

The piezoelectric elements 4 are rectangular strips, each measuring approximately 1 mm wide by 4 mm long by 0.15 mm thick. Mounted to the outside surface of each diaphragm 3 at the locations of the pressure chambers 202, they serve as pressure sources of the individual dot printing sections 101. The individual piezoelectric elements 4 are bimorph cells produced by depositing PZT layers 41 and 42 on both sides of individual titanium strips 51 (or crystallizing teeth 51) projecting from a electrode member 5 by the hydrothermal synthesis technique, and then forming driving electrodes 6 and 6' on the top and bottom surfaces of the PZT layers 41 and 42, respectively, as shown in FIG. 6.

As will be discussed later in further detail, the piezoelectric elements 4 are constructed with the comb-like electrode member 5 (FIG. 5) made of titanium which has a plurality of crystallizing teeth 51 projecting from a connecting strip 52 at the same intervals as the front and rear piezoelectric elements 4 are aligned. It will therefore be recognized that the piezoelectric elements 4 are interconnected by the electrode member 5.

The PZT layers 41, 42 are polarized in directions in which a driving voltage is applied (i.e., at right angles to the electrodes 6, 6'). More particularly, each PZT layer 41 is polarized in the direction from the top-side electrode 6 toward the titanium plate 51 while each PZT layer 42 is polarized in the direction from the bottom-side electrode 6' toward the titanium plate 51 as shown by arrows in FIG. 3.

The aforementioned printing head 1 is produced in the following manner. First, the substrate 2 and diaphragms 3 are produced by the above-described processes. Then, the bimorph-cell-type piezoelectric elements 4 are made in the following procedure.

Figure 5:
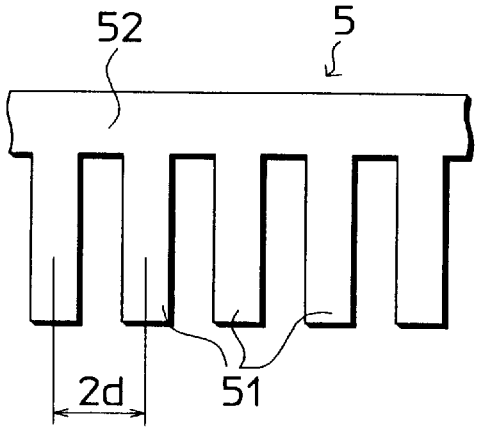
FIG. 5 is a plan view showing an electrode member of a first form.

Specifically, the connecting strip 52 of each comb-like electrode member 5 shown in FIG. 5 is covered with a resist layer, and PZT is deposited on the top and bottom sides of the individual crystallizing teeth 51 by the hydrothermal synthesis technique. As already mentioned, the crystallizing teeth 51 of each electrode member 5 are interconnected at the same intervals as the piezoelectric elements 4 which are arranged in a line (i.e., every second piezoelectric elements 4 arranged on each diaphragm 3).

Figure 7:
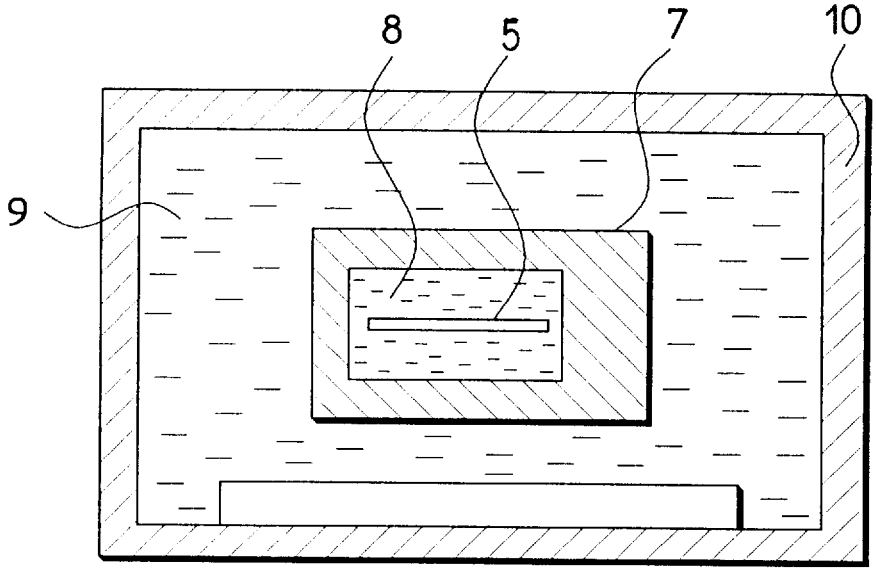
FIG. 7 is a diagram showing how PZT is deposited on the crystallizing teeth of the electrode member by hydrothermal synthesis technique FIG. 8 a plan view showing an electrode member of a second form.

FIG. 7 is a diagram showing how PZT is deposited on the crystallizing teeth 51 of each electrode member 5 by the hydrothermal synthesis technique.

Deposition of PZT on the crystallizing teeth 51 of an electrode member 5 comprises a first process in which crystal nuclei of PZT are formed on the crystallizing teeth 51 of the electrode member 5 and a second process in which crystals of PZT are grown around the individual crystal nuclei. The second process is repeated until a desired thickness of PZT is obtained.

In the first process, the electrode member 5 is immersed in an autoclave 7 holding an aqueous solution 8 containing lead nitrate ($Pb(NO_3)_2$), zirconium oxychloride ($ZrOCl_2.8H_2O$) and potassium hydroxide (KOH(8N)) at a specified ratio so that the molar ratio Pb/Zr between lead (Pb) and zirconium (Zr) becomes approximately 2.29, and the autoclave 7 is placed within a bath of a thermostatic chamber 10 filled with silicone oil 9 and heated under specified temperature conditions (e.g., 150° C. for a duration of 48 hours).

In the second process, the electrode member 5 which has undergone the first process is immersed in the autoclave 7 holding another aqueous solution 8' containing lead nitrate ($Pb(NO_3)_2$), zirconium oxychloride ($ZrOCl_2.8H_2O$), titanium tetrachloride ($TiCl_4$) and potassium hydroxide (KOH (4N)) at a specified ratio so that the molar ratio among lead (Pb), zirconium (Zr) and titanium (Ti) becomes Pb:Zr:Ti= 110:52:48, and the autoclave 7 is placed within the bath of the thermostatic chamber 10 filled with silicone oil 9 and heated under specified temperature conditions (e.g., 120° C. or a duration of 24 hours).

As the electrode member 5 is successively immersed in the aqueous solutions 8 and 8' under high temperature, high pressure conditions as described above, crystal nuclei of PZT are made on the top and bottom sides of the individual crystallizing teeth 51 of the electrode member 5, and PZT crystals grow in vertical directions from the respective nuclei so that the PZT layers 41 and 42 are eventually formed on both sides of the crystallizing teeth 51, as shown in FIG. 6. Since PZT is polarized opposite to the direction in which its crystals grow, the PZT layers 41 and 42 exhibit such characteristics that their polarities are both directed toward the crystallizing teeth 51.

When deposition of the PZT layers 41 and 42 has been completed, the electrode member 5 is washed with distilled water, and the electrodes 6 and 6' are formed with nickel, for instance, on the surfaces of the PZT layers 41 and 42, respectively, to complete the bimorph-cell-type piezoelectric elements 4.

Then, the diaphragms 3 are bonded to both sides of the substrate 2 with an epoxy adhesive and the bimorph-cell-type piezoelectric elements 4 interconnected by the electrode member 5 are bonded in exact attachment positions on the diaphragms 3 with an epoxy adhesive.

Figure 8:
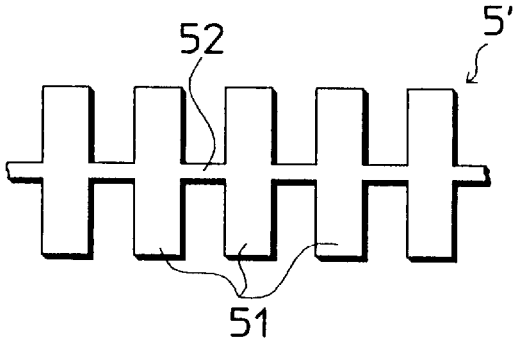
Figure 9:
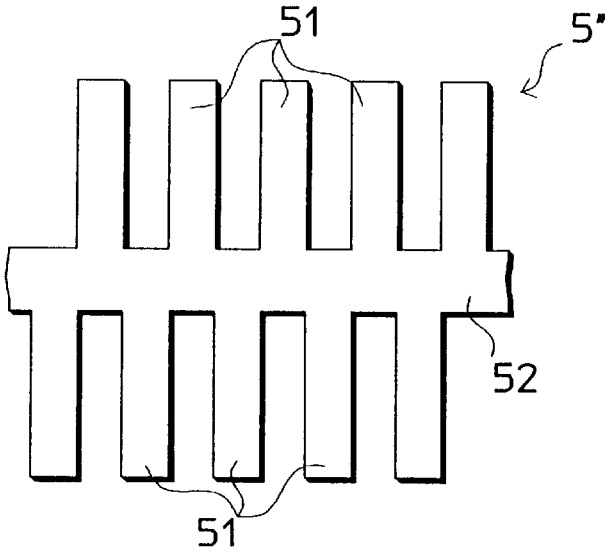
FIG. 9 is a plan view showing an electrode member of a third form.

Although the electrode member 5 has a comb-like shape in the above embodiment, it is not limited to that shape as long as the individual crystallizing teeth 51 are connected together at specified intervals. As an example, the electrode member 5 may be constructed like a double-edged comb with its connecting strip 52 passing the middle of successive crystallizing teeth 51 as shown in FIG. 8. Furthermore, although the printing head 1 of the above embodiment has a pair of comb-like electrode members 5 shown in FIG. 5 on each side, these electrode members 5 may be replaced by a single electrode member 5' of which crystallizing teeth 51 are alternately arranged on each side of a connecting strip 52 as shown in FIG. 9.

As seen above, the bimorph-cell-type piezoelectric elements 4 are constructed by depositing the PZT layers 41 and 42 on both sides of the individual titanium strips 51 (or crystallizing teeth 51) of the electrode member 5 by using the hydrothermal synthesis technique, and then forming the driving electrodes 6 and 6' on the top and bottom surfaces of the PZT layers 41 and 42, respectively. The bimorph-cell-type piezoelectric elements 4 can be produced with ease and high positioning accuracy in this manner.

Since the bimorph-cell-type piezoelectric elements 4 are made by depositing the PZT layers 41 and 42 on the crystallizing teeth 51 which are readily arranged at the intended intervals of the piezoelectric elements 4, it is possible to quickly produce the piezoelectric elements 4 in large quantities. This construction facilitates exact positioning of the individual piezoelectric elements 4 on the diaphragms 3, simplifies the assembly processes of the printing head 1 and thus improves labor efficiency.

Figure 11:
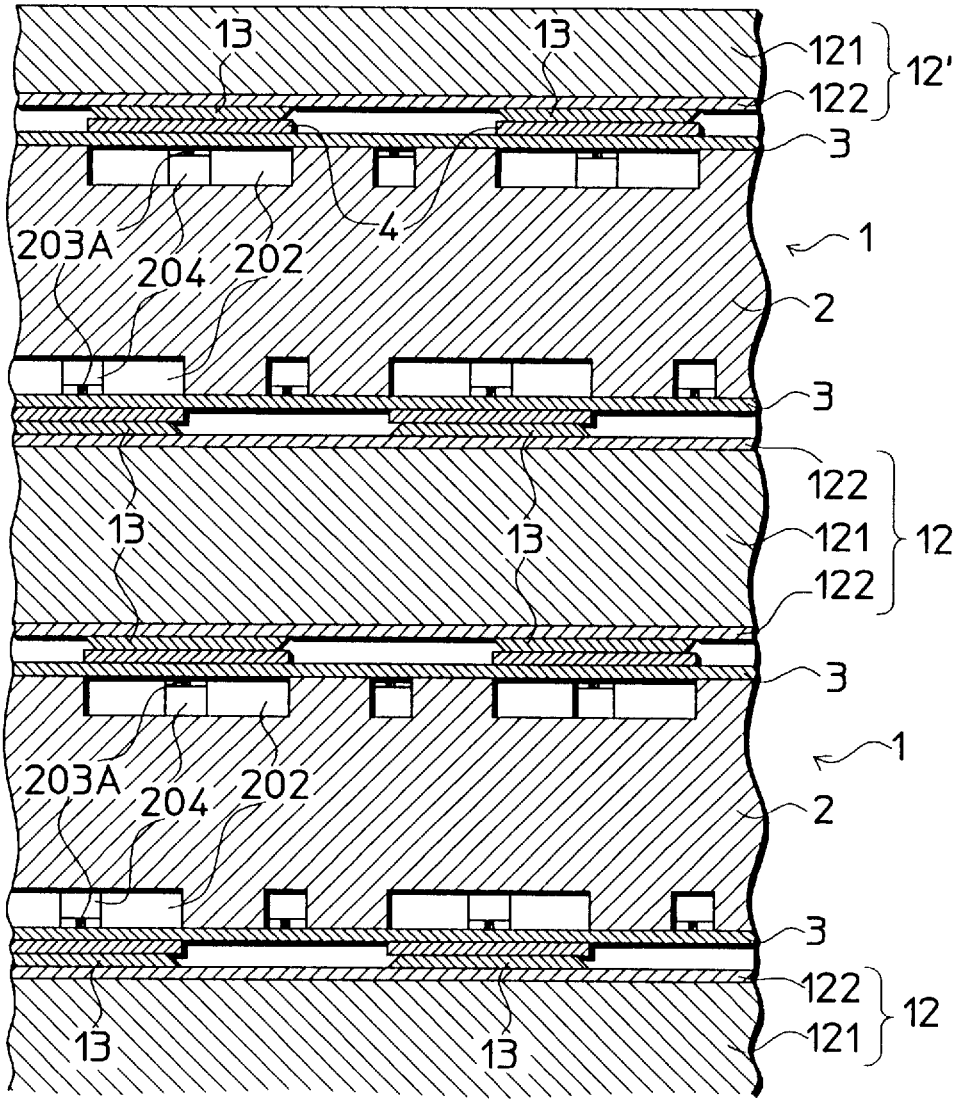
FIG. 11 a fragmentary sectional view of a head block of the line head.

FIG. 10 is a perspective view of the line head 11 comprising an assembled stack of multiple printing heads 1. To construct the line head 11, a head block 111 is produced by stacking ten printing heads 1 in electrode plates 12 and 12' in layers as shown in FIG. 11, and the rear end of the head block 111 is supported by a retaining block 112. Consequently, 100 ink jet outlets 203A are arranged in a matrix of 20 rows by 255 columns on a front end face 11*a* of the line head 11.

It is to be noted that the ink jet outlets 203A in even number rows (i.e., the ink jet outlets 203A formed on the bottom side of each printing head 1) are offset in a lateral direction by as much as half the horizontal dot pitch with respect to the ink jet outlets 203A in odd number rows (i.e., the ink jet outlets 203A formed on the top side of each printing head 1).

The retaining block 112 serves not only as a connector for connecting piezoelectric element control lines provided on the electrode plates 12 and 12' to an unillustrated drive and control circuit, but also as an ink supply unit for supplying ink from an unillustrated ink tank to the ink reservoirs 201 of the individual printing heads 1.

FIG. 11 is a fragmentary sectional view of the head block 111. As already mentioned, the head block 111 is constructed by stacking ten printing heads 1 together with the electrode plates 12 and 12' in layers. Each electrode plate 12 inserted between two printing heads 1 is made by bonding a pair of flexible printed circuits (hereinafter referred to as "FPC") 122 on which control lines and connecting electrodes 13 are preformed to both sides of an insulator substrate 121. Each electrode plate 12' mounted on the top of the uppermost printing head 1 or on the bottom of the lowermost printing head 1 is produced by bonding one FPC 122 on which control lines and connecting electrodes 13 are preformed to one side of an insulator substrate 121.

The substrate 121 of each electrode plate 12 has a thickness of about 1 mm. Accordingly, the spacing between the arrays of ink jet outlets 203A becomes about 1 mm.

Having the same shape as the printing heads 1 in plan view, the electrode plates 12 and 12' are pressure-welded to the top and/or bottom of the individual printing heads 1. With this arrangement, the connecting electrodes 13 formed on the FPC's 122 of the electrode plates 12 and 12' are securely connected to the corresponding electrodes 6 formed on the piezoelectric elements 4. As a result, the piezoelectric elements 4 are connected to the respective control lines via the connecting electrodes 13. The individual piezoelectric elements 4 are thus connected to the aforementioned drive and control circuit by way of the control lines of the FPC's 122, diaphragms 3 (common electrodes) and retaining block 112.

Figure 12:
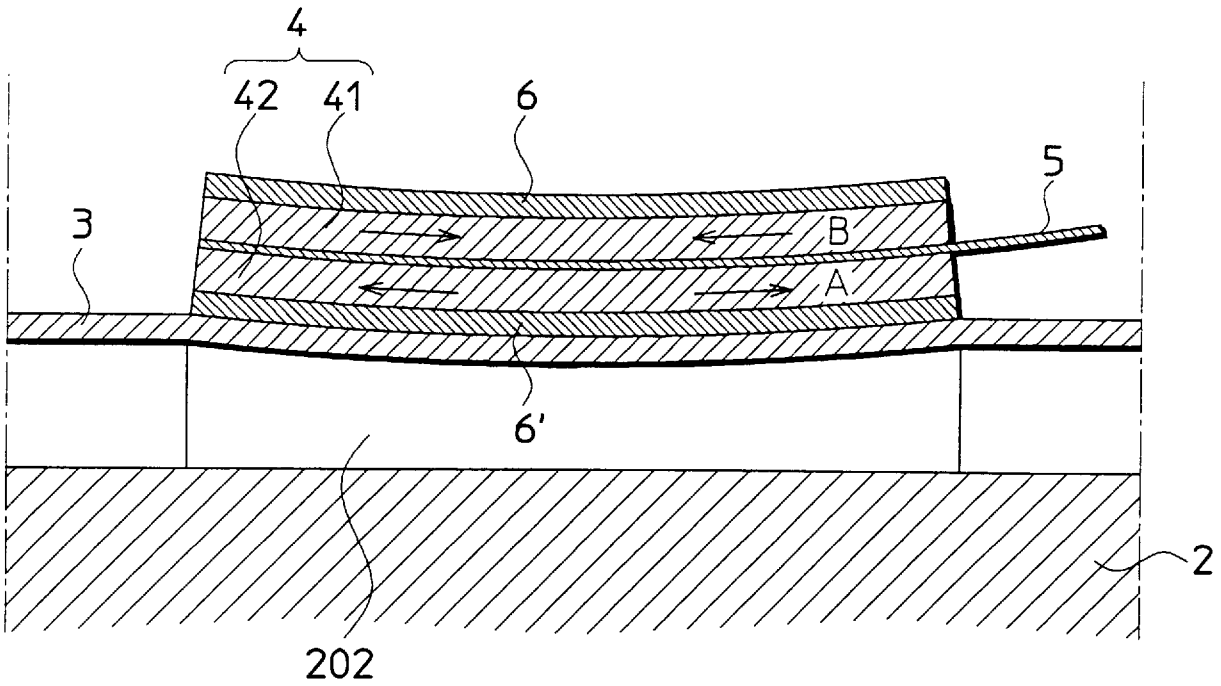
FIG. 12 a fragmentary sectional view showing a state where electrostrictions are caused in a bimorph-cell-type piezoelectric element.

With thus constructed piezoelectric element 4, when a voltage fed from the drive and control circuit is applied across the electrode 6 of the piezoelectric element 4 and the ITO layer 32 of the diaphragm 3, resultant electrostrictions cause the PZT layer 42 to expand (as shown by arrows A in FIG. 12) and the PZT layer 41 to contract (as shown by arrows B in FIG. 12). The electrostrictions produced in both PZT layers 41, 42 are combined into a strong force to bend the piezoelectric element 4 toward the diaphragms 3. As a result, the diaphragm 3 is bent into the pressure chamber 202 so that ink is pressurized and spewed out from the relevant ink jet outlet 203A.

Compared to piezoelectric elements having single PZT layers 42 alone, the bimorph-cell-type piezoelectric elements 4 produce a greater pressurizing force to be applied to ink. This would help reduce variations in ink drop ejecting performance among the individual dot printing sections 101.

Figure 13:
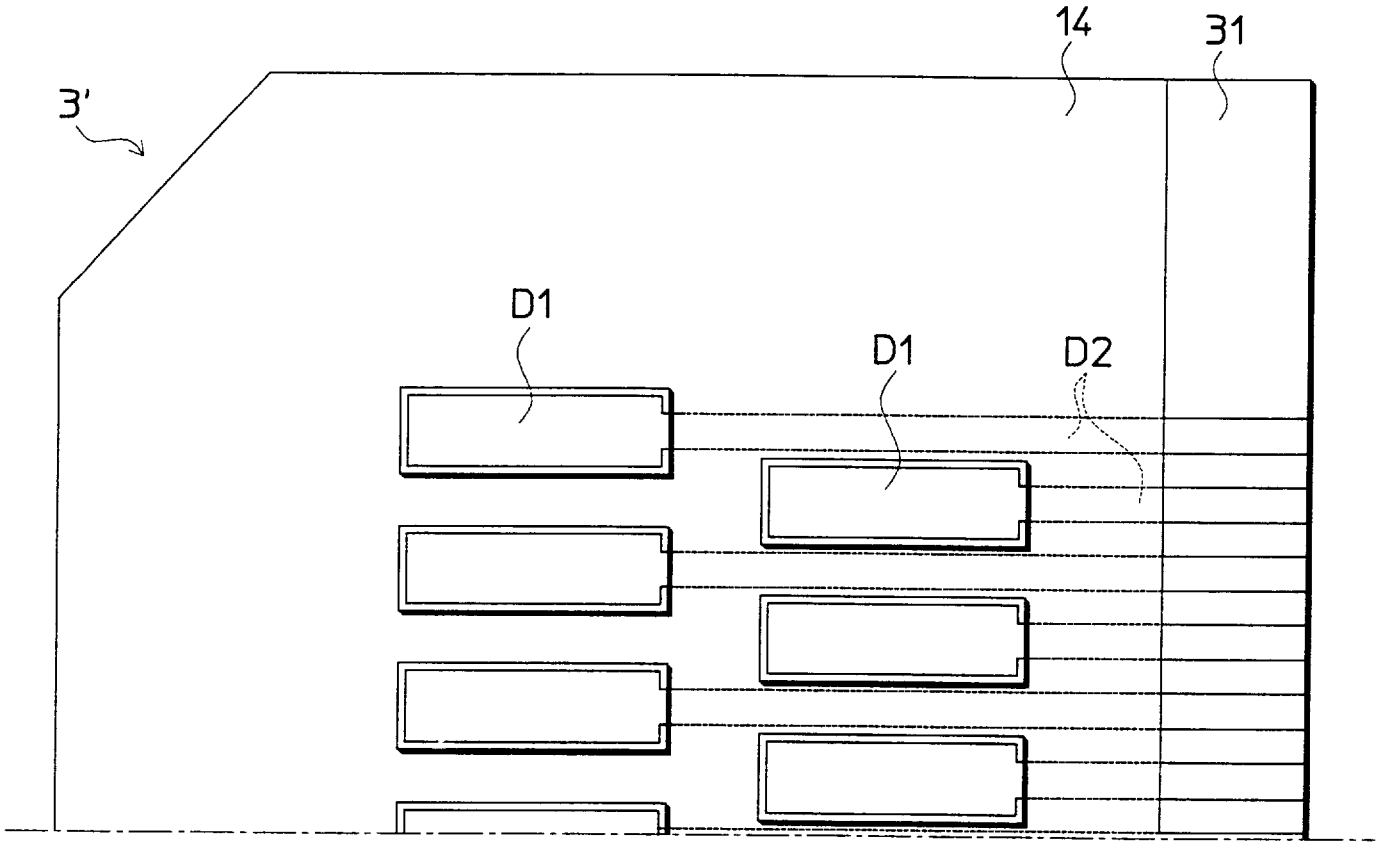
FIG. 13 is a fragmentary plan view showing a printing head as a second embodiment of the invention.
Figure 14:
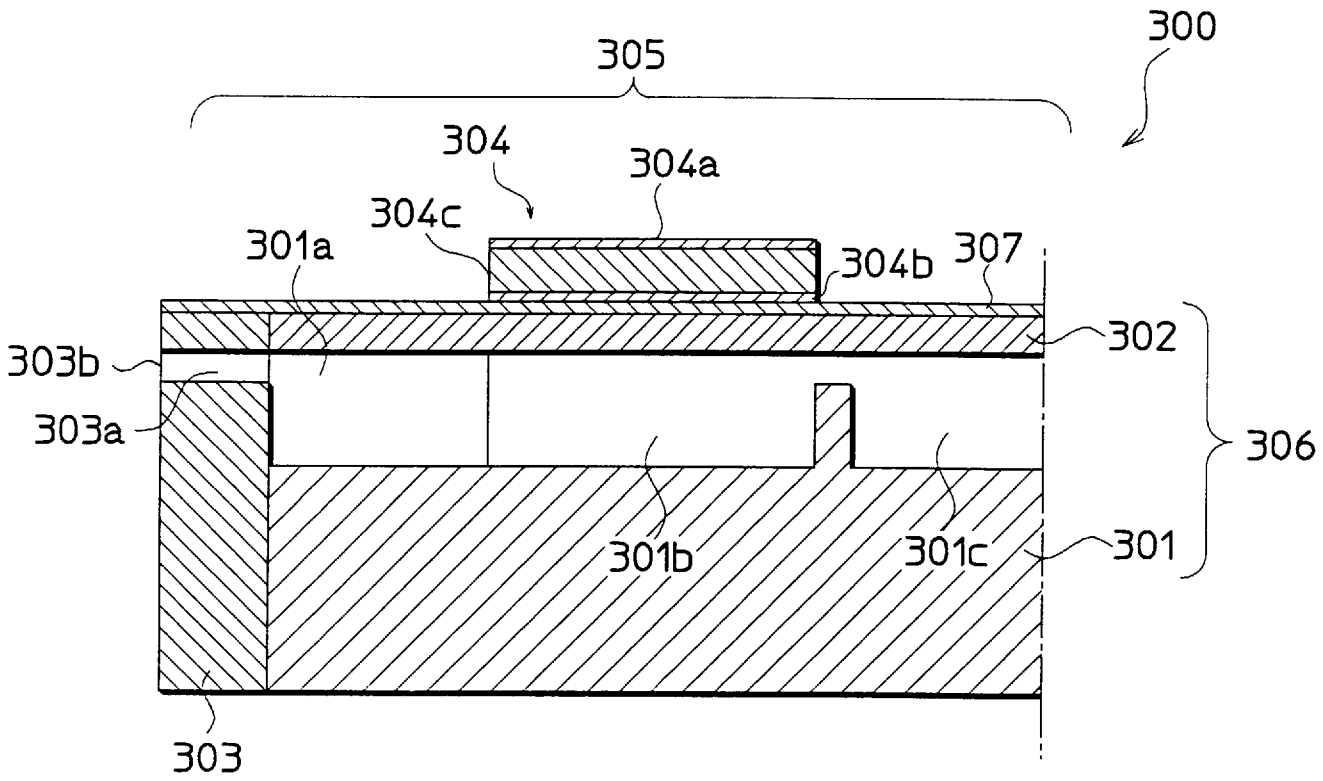
PRIOR ART FIG. 14
FIG. 14 fragmentary sectional view showing a construction of a conventional Kyser type printing head.

Although each diaphragm 3 to be bonded to the substrate 2 carries a common electrode (i.e., ITO layer 32) for the piezoelectric elements 4 in the above embodiment, there may be made independent electrodes for the individual piezoelectric elements 4 on each diaphragm 3' as shown in FIG. 13, for instance.

The diaphragm 3' of FIG. 13 has basically the same construction as the diaphragm 3 of the first embodiment. Specifically, electrodes D1 made of ITO layers are formed on a glass plate 31 at locations where Piezoelectric elements are to be made and line electrodes D2 are formed to connect between the electrodes D1 and the rear end of the glass plate 31 through a spattering or metallizing process, for instance. The diaphragm 3' is covered with a resist layer 14 excluding such areas as the rear end portion of the glass plate 31 and where the electrodes D1 are made.

In this alternative configuration where the diaphragm 3' has the independent electrodes D1 for the individual piezoelectric elements 4, the electrodes 6 formed on the outside surfaces of the individual piezoelectric elements 4 serve as earth electrodes and the connecting electrodes 13 formed on each FPC 122 of the electrode plates 12 and 12' are used as common electrodes. The electrodes 6 on the piezoelectric elements 4 are therefore interconnected to each other via the connecting electrodes 13. When the independent electrodes D1 for the piezoelectric elements 4 are formed on each diaphragm 3', it is possible to pressure-weld the electrode plates 12 and 12' to the printing heads 1 without worrying about positioning accuracy, which makes it easier to assemble the line head 11.

What is claimed is:

1. A printing head for an ink printer comprising:

a plurality of ink jets, each of said plurality of ink jets including:

an ink nozzle through which ink is ejected, a pressure chamber communicated with said ink nozzle and having a flexible plate diaphragm having an inside surface forming an inner wall of said pressure chamber and an outside surface opposite said inside surface, and a piezoelectric member bonded on said outside surface of said flexible plate diaphragm for deforming said flexible plate diaphragm to eject ink through said ink nozzle from said pressure chamber, said piezoelectric member including:

a titanium member having an upper surface and a low surface, said titanium member having a chemically bonded upper PZT layer chemically bonded on said upper surface of said titanium member and polarized in a first direction, and said titanium member having a chemically bonded lower PZT layer chemically bonded on said lower surface of said titanium member and polarized in a second direction opposite to said first direction;

an interconnecting member elongated in a lengthwise direction thereof and having a first side and a second side opposite said first side, said first side and said second side extending in said lengthwise direction;

said titanium member of said plurality of ink jets being interconnected to each other by said interconnecting member, said interconnecting member being integrally formed with said titanium member to from a single titanium plate comb having teeth wherein said titanium members correspond to said teeth;

said teeth including a first group of teeth extending from said first side of said interconnecting member, said first group of teeth being arranged at a predetermined interval in said lengthwise direction of said interconnecting member; and said teeth including a second group of teeth extending from said second side of said interconnecting member, said second group second group of teeth being arranged at a predetermined interval in said lengthwise direction of said interconnecting member, said second group of teeth being shifted with respect to said first group of teeth by a predetermined distance.

2. A printing head for an ink printer comprising:

a plurality of ink jets, each of said plurality of ink jets including:

an ink nozzle through which ink is ejected, a pressure chamber communicated with said ink nozzle and having a flexible plate diaphragm having an inside surface forming an inner wall of said pressure chamber and an outside surface opposite said inside surface, and a piezoelectric member bonded on said outside surface of said flexible plate diaphragm for deforming said flexible plate diaphragm to eject ink through said ink nozzle from said pressure chamber, said piezoelectric member including:

a titanium member having an upper surface and a lower surface, said titanium member having a upper PZT layer on said upper surface of said titanium member and polarized in a first direction, and said titanium member having a lower PZT layer on said lower surface of said titanium member and polarized in a second direction opposite to said first direction;

an interconnecting member elongated in a lengthwise direction thereof and having a first side and a second side opposite said first side, said first side and said second side extending in said lengthwise direction;

said titanium member of said plurality of ink jets being interconnected to each other by said interconnecting member, said interconnecting member being integrally formed with said titanium members to form a single titanium plate comb having teeth wherein said titanium members correspond to said teeth;

said teeth including a first group of teeth extending from said first side of said interconnecting member, said first group of teeth being arranged at a predetermined interval in said lengthwise direction of said interconnecting member; and said teeth including a second group of teeth extending from said second said of said interconnecting member, said second group of teeth being arranged at a predetermined interval in said lengthwise direction of said interconnecting member, said second group of teeth being shifted with respect to said first group of teeth by a predetermined distance.

* * * * *